US007621324B2

(12) United States Patent
Atencio

(10) Patent No.: US 7,621,324 B2
(45) Date of Patent: Nov. 24, 2009

(54) AUTOMATED FLOWBACK AND INFORMATION SYSTEM

(76) Inventor: Don Atencio, 4714 Sundown Rd., Farmington, NM (US) 87801

( * ) Notice: Subject to any disclaimer, the term of this patent is extended or adjusted under 35 U.S.C. 154(b) by 93 days.

(21) Appl. No.: 11/731,382

(22) Filed: Mar. 29, 2007

(65) Prior Publication Data

US 2007/0227722 A1 Oct. 4, 2007

Related U.S. Application Data

(60) Provisional application No. 60/787,456, filed on Mar. 30, 2006.

(51) Int. Cl.
*E21B 43/12* (2006.01)

(52) U.S. Cl. ..... 166/250.15; 166/91.1

(58) Field of Classification Search ..... 166/91.1, 166/53, 75.12, 95.1, 373, 379, 250.15; 138/120, 138/125, 250
See application file for complete search history.

(56) References Cited

U.S. PATENT DOCUMENTS 4,083,409 A * 4/1978 Barrington ..... 166/320
4,161,215 A * 7/1979 Bourne et al. ..... 166/66.7
4,898,236 A * 2/1990 Sask ..... 166/65.1
5,070,457 A 12/1991 Poulsen
5,330,005 A 7/1994 Card et al.
5,431,224 A 7/1995 Laali
5,439,055 A 8/1995 Card et al.
5,501,275 A 3/1996 Card et al.
5,667,012 A 9/1997 Hoover et al.
5,775,425 A 7/1998 Weaver et al.
5,787,986 A 8/1998 Weaver et al.
5,833,000 A 11/1998 Weaver et al.
5,839,510 A 11/1998 Weaver et al.
5,853,048 A 12/1998 Weaver et al.
5,871,049 A 2/1999 Weaver et al.
6,047,772 A 4/2000 Weaver et al.
6,172,011 B1 1/2001 Card et al.
6,209,643 B1 4/2001 Nguyen
6,554,064 B1 * 4/2003 Restarick et al. ..... 166/250.01
6,626,241 B2 9/2003 Nguyen
6,659,179 B2 12/2003 Nguyen
6,776,239 B2 8/2004 Eslinger et al.
6,793,018 B2 9/2004 Dawson et al.
6,983,801 B2 1/2006 Dawson et al.
6,988,552 B2 1/2006 Wilson et al.
7,086,460 B2 8/2006 Nguyen et al.
7,105,716 B2 9/2006 Baratian et al.
2002/0027002 A1 * 3/2002 Carmody et al. ..... 166/66
2002/0134549 A1 * 9/2002 Marangoni et al. ..... 166/242.1

* cited by examiner

*Primary Examiner*—David J Bagnell
*Assistant Examiner*—James G Sayre
(74) *Attorney, Agent, or Firm*—Dennis F. Armijo

(57) ABSTRACT

An automated flowback system allows control and operation of the system from a remote location away from the dangers of high-pressure gases or abrasives traveling at high velocities that cause damage or failure to equipment piping valves. The system provides techniques and mechanical components installed in flowlines in any position without having to cut and thread, weld or fabricate pipe to fit. This system includes an expansion sub with axial adjusting lengths adequate to compensate for variations between two points. The expansion sub is secured and installed into position eliminating field cut and threading, welding or fabrication. The system also includes a blast barrel with an installed choke nipple, choke bean or choke insert with a chosen orifice size for multiple chambered ports. The blast barrel retracts between two fixed points without having to dismantle any connections or be removed from the fluid flow.

22 Claims, 3 Drawing Sheets

AUTOMATED FLOWBACK AND INFORMATION SYSTEM

CROSS-REFERENCE TO RELATED APPLICATIONS

This application is based on U.S. Provisional Application Ser. No. 60/787,456, entitled "Automated Flowback and Information System" filed on Mar. 30, 2006, the teachings of which are incorporated herein by reference.

BACKGROUND OF THE INVENTION

1. Field of the Invention (Technical Field)

The present invention relates to oil and gas wells, and more particularly to a system for providing a controlled flowback from the wellbore after a treatment procedure.

2. Background Art

Most oil and gas wells require some form of stimulation to enhance hydrocarbon flow to make or keep them economically viable. The servicing of oil and gas wells to stimulate production requires the pumping of fluids under high-pressure. The fluids are generally corrosive and abrasive because they are frequently laden with corrosive acids and abrasive propellants such as sharp sand, shale, coal or the like.

The components which make up the wellhead, typically, valves, a tubing hanger, a casing hanger, a casing head, and a blowout preventer (BOP) system, are generally selected for the characteristics of the well and not the flowback process and procedures. The abrasive propellants and or corrosive fluids required for well fracturing and stimulation procedures are required to fracture the formation to allow oil or gas to flow into the wellbore. After the well fracturing process has been completed, a procedure called flowback is conducted. This procedure is a controlled process of allowing fluids to flow from the wellbore following treatment either in preparation for a subsequent phase of treatment or preparation for cleanup and returning the well to production.

The clean up period or flowback, generally follows a stimulation (called a frac job) treatment during which time treatment fluids return from the reservoir formation and wellbore. Depending on the treatment, the cleanup period can be short and uncomplicated. However, in more complicated and complex larger fracturing jobs the flowback process can become much more complex and hazardous. The controlled flowback process should be conducted carefully to avoid jeopardizing safety, equipment, environment or the long-term efficiency of the well stimulation.

There are many different methods, techniques, processes and types of flowback practiced in the oil and gas industry used to cleanup a wellbore and formation after the fracturing process has been completed. The prior art flowback procedures all generally utilized the same or similar types of components, parts, apparatuses, and methods, that are standards and known by those experienced in the art in the oil and gas industry. Most known flowback methods use some sort of part, apparatus or technique of controlling the pressures and rate of velocity of the fluids and propellants returning from the formation during clean out.

These parts are commonly know as wellhead Christmas trees, casing valves, frac valves, flowback trees, frac stacks, casing isolation tools, tubing isolation tools, frac Y's, blowout preventer (BOP), chokes, choke manifolds, adjustable chokes, positive chokes, ceramic chokes, inline chokes, choke inserts, choke beans, choke nipples, cage nipples, and many various other apparatuses that attach, screw on, bolt on, hammer on, and clamp on to the flowback lines, equipment and parts. These parts and apparatuses or combination thereof, are used to perform a flowback and cleanup of wellbore and well formations.

There are many problems associated with the conventional methods and practices used to flowback a well using current industry standards, equipment or methods. One such problem is the installation of flowlines that connect or mate from a horizontal position to a targeted tee then to a vertical targeted tee, then back to line laying in the horizontal position on the ground. The problem occurs because the distance and heights vary from location to location for various reasons, terrain, equipment configuration, styles, and placement of the wellhead and the surface casing. For these reasons, flowline connections to flowback tree or horizontal valves, used to connect, vary and require pipe to be cut, welded or fabricated to mate connections. Because of weather elements such as rain, wind, mud, snow, and cold, this function cannot be performed in an optimum environment so the quality and safety of the work performed could be compromised. Pipe threading and welding or fabricating are best preformed in a controlled environment. Other common problems that occur during installation are that many variables exist, such as lines that attach to choke manifolds or flowback tanks and earthed pits, all require variable lengths to mate connections. There are other problems, such as current flowbacks do not have a way to contain the pressures or corrosive acids and abrasive propellants such as sharp sand. The problem arises because the propellant fluids, acids, chemicals, and fracture products pumped into the wellbore formation during (flowback) clean up, travel at high velocity causing washing out of the lines and equipment from the inside out. The current flowback practices have no method or system to contain, control or monitor a washout. In addition, there is not a system that detects a washout or a warning system to notify when a potential washout might occur. When this event occurs, gases, propellants, fluids, acids, and chemicals could vent to the atmosphere causing unsafe conditions, injury and environmental contamination.

SUMMARY OF THE INVENTION

Disclosure of the Invention

The embodiments disclosed herein address the above stated needs by providing a flowback system for oil and gas wells. The new automated flowback system provides protection from all the hazards mentioned above. This flowback is a system that incorporates proven standard oilfield practices with new technology and mechanisms to solve flowback safety, mechanical, operational and environmental issues. The new system provides new techniques and mechanical devices that may be installed in flowlines, in the vertical or the horizontal position, without having to cut and thread, weld or fabricate pipe to fit. This new system provides an expansion sub, which is a mechanism with axial adjusting lengths adequate to compensate for variations in a distance between two points. This allows the expansion sub to be secured and installed precisely and quickly into position, eliminating field cut and threading, welding or fabrication. The expansion sub also provides multiple wash barriers for safety and prevention of washouts. The expansion sub can be manufactured in various lengths and sizes to adapt to any vertical or horizontal application, making it very desirable from a time, cost, safety, and environmental standpoint.

In addition, this system advantageously provides a blast barrel that permits the ability to install a choke nipple, choke bean or choke insert with an orifice size chosen by a user into a multiple chambered apparatus. This apparatus, once in place, provides a service technician an in-line method to rotate the outer chamber counter clockwise so the outer chamber of the blast barrel slides away from the primary barrel head. Once this process is completed the inner flowtube, blast nipple and the cage nipple are visible. Next, the inner flowtube is rotated counter clockwise and it will retract within the expansion chamber, away from the barrelhead, releasing the blast nipple that can be removed or installed. The cage nipple can also be removed, and the choke insert can be installed or removed. Reassembly is performed in reverse order and the apparatus is ready for operation. These unique functions give the blast barrel assembly the ability to retract between two fixed points without having to disassemble or dismantle any connections or be removed from the secured flowlines for installation of a choke insert, blast nipple or to replace damaged or used internal parts. This apparatus also provides pressure ports that allow for monitoring of the upstream wellhead pressure by attaching an electronic pressure sensor module or high-pressure line to the primary barrelhead high-pressure chamber port. The actual pressure can safely be monitored and reported from a remote location. Additionally, a system for creating an electronic or manual chart, that records and documents history of the process, can be used. This information can be used to document the efficiency, and also help design procedure for future flowback operations.

Another important embodiment is the provision of a monitoring port located in the center of the outer barrel known as the breach chamber. This chamber is equipped with internal high-pressure seals for containment. The monitoring port embodiment provides a safe method to monitor flowback operations away from a potential hazard or danger. The monitoring module attached to this chamber monitors whether a washout or breach of the choke insert, blast nipple or inner flowtube occurs. Thus, the system is able to alert a technician by sending an alarm signal to a command center automatically, shutting the system down or transmitting signals to close or open an alternate line. This alert or signal provides notice that the inner parts have been compromised and need to be replaced. The unique design and features of the blastbarrel provide notice, even though the internal parts have been compromised, worn or washed out. The preferred design of the monitoring port is fabricated from hardened materials, which give it the ability to withstand the corrosive demand made on equipment during the flowback process for long periods of time. If a breach occurs, the system is still safe and secure, because the inner tubes and parts are encased within the outer barrel or breach chamber. The outer barrel is able to contain the pressures and abrasives internally for an indefinite amount of time. This allows the operator adequate time to alleviate the problem by shutting down and transferring the flow to another flowline equipped with the same system.

The blast barrel assembly is preferably equipped with an expansion chamber in the lower assembly which provides the inner flowtube the ability to rotate counter clockwise and travel away from the blast nipple and barrelhead, releasing it from the inner lock position and unlocking the internal seals, allowing the internal parts to be removed and replaced as required. The expansion chamber is also equipped with the third port for allowing a pressure module to be installed to monitor the low-pressure chamber. By monitoring this chamber, a technician is able to calculate wear by comparing the upstream high-pressure and down stream low-pressure differentials and the orifice size installed in the blast barrel. For example, if there is 1000 pound per square inch (PSI) measured at the high-pressure barrelhead monitor, and a one quarter inch (¼") orifice with one hundred twenty-five (125) PSI on the low-pressure monitor there is a pressure differential of eight hundred seventy-five (875) PSI. As the orifice begins to wear, the pressure differential becomes less, by using the charts and calculations an operator is able to avert wash or damage, and at the same time maintain total control of the flowback process by comparing and analyzing the data and readings coming from the blast barrel ports. These readings and information can be automatically recorded and documented on charts or graphs in real time, and transferred via satellite or cell phone to any office or location of choice for real time evaluation. This information permits the site technician or central engineering office to view real time information and interpret it into useful data and can be used in making crucial decisions and operational functions, safely away from the wellhead.

It is the object of the present invention to provide a flowback system that improves operational job standards and job site quality assurance, as well as safety, health, environmental, and economic efficiencies.

Another object of the present invention is to provide a quick and efficient mechanical apparatus to be able to adjust quickly to variable lengths and fit between two fixed connecting points, without requiring cutting, threading, welding or fabrication.

It is another object of the present invention to provide a blast barrel that is able to withstand high pressures, corrosive fluids, and abrasive propellants traveling at high velocities for long periods and to be able to incorporate washout containment safety features.

Yet another object of the present invention is to provide the ability to transmit data to a mobile command receiving center or central office for real time data interpretation, and the ability to remotely control or operate the system.

It is also the object of the present invention to provide a system that notifies a user that a breach of the interior parts have been compromised or damaged and still be able to safely continue operations, allowing the user the flexibility and time required to safely make alternate decisions and adjustments to the system.

An advantage of the present invention is that it is a quick, economical, and efficient system; yet still able to contain extreme pressures and abrasives traveling at high velocities.

Another advantage of the present invention is the ability of the blast barrel to retract between two fixed points for disassembly giving the user access to internal parts for replacement or inspection without having to dismantle the high-pressure fixed lines.

Yet another advantage of the present invention is that the system can be programmed to operate and function automatically from a control office or command center.

Other objects, advantages and novel features, and further scope of applicability of the present invention will be set forth in part in the detailed description to follow, taken in conjunction with the accompanying drawings, and in part will become apparent to those skilled in the art upon examination of the following, or may be learned by practice of the invention. The objects and advantages of the invention may be realized and attained by means of the instrumentalities and combinations particularly pointed out in the appended claims.

BRIEF DESCRIPTION OF THE DRAWINGS

The accompanying drawings, which are incorporated into and form a part of the specification, illustrate several embodiments of the present invention and, together with the description, serve to explain the principles of the invention. The drawings are only for the purpose of illustrating a preferred embodiment of the invention and are not to be construed as limiting the invention. In the drawings.

DESCRIPTION OF THE PREFERRED EMBODIMENTS

Best Modes for Carrying Out the Invention

Figure 1:
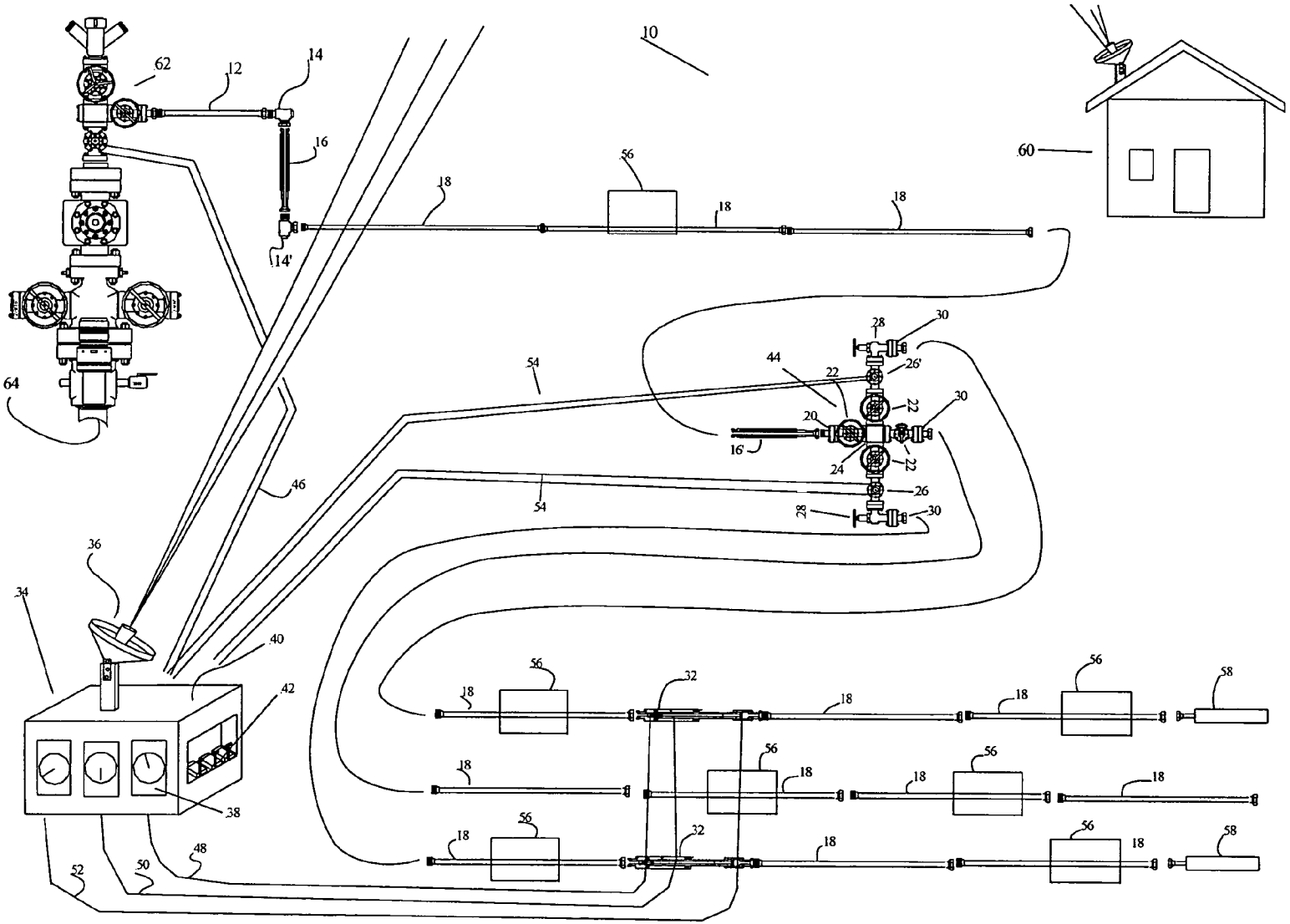
FIG. 1 depicts an embodiment of the invention showing the overall system with the preferred components.

FIG. 1 shows an overall view of the equipment and component parts as assembled in a complete field installation hereinafter referred to as a flowback system 10. Flowback system 10 includes a frac tree flowback tree 62 which include a series of valves that can be of various sizes and pressure ratings used in opening and closing the well 64 before and after fracturing stimulation and flowback clean up of a well. A high-pressure flowline, pup joint or sub 12 of various sizes and pressure ratings are installed in a horizontal position, and vary in length based on the application. High-pressure flowlines 18 are typically attached or installed by a connection, known in the oil and gas industry, as a hammer union (not shown). These connections are made by rotating the wingnut portion of the union onto the threaded portion of the union, and connected to integral union cushion elbow or targeted tee 14. The integral union cushion elbow 14 is designed to absorb and deflect the products being carried by the internal flow of the wellbore during clean out. Integral union cushion elbow 14 is connected to a first end of expansion sub 16, a mechanism with axial adjusting lengths adequate to compensate far variations in a distance between two fixed points. Expansion subs 16 and 16' are designed to be secured and installed precisely and quickly into a vertical position eliminating the need of having to cut, fit, thread, weld, or field fabricate. Expansion subs 16 and 16' are shown in detail in FIG. 2 and defined later on in this application.

A second end of expansion sub 16 is connected to another integral union cushion elbow or targeted tee 14, as shown. Connected to the second integral union cushion elbow 14' are high-pressure flowlines 18, known as pup joint or sub, which can be of various sizes and pressure ratings. High-pressure flowlines 18 are installed and secured by adjustable cement blocks 56, which are designed to restrain movement of the high-pressure flowlines 18 in a horizontal position. High-pressure flowlines 18 or the pup joints 12 vary in length and quantity requirements, and are based on distance and application. High-pressure flowlines 18 are also attached or installed by hammer unions (not shown). A second end of high-pressure flowlines 18 is connected to a second expansion sub 16', as shown. Second expansion sub 16' is connected to a choke and kill manifold assembly 44. An integrated one-piece flange 20 with a hammer union thread half connection is mated to choke and kill manifold 44 and is attached to manually operated gate valves 22, which are of various sizes or pressures ratings depending on the well. Manually operated gate valves 22 are used to close, block or divert flow to alternate sides or ports on choke manifold 44. A user is then able to apply flow, to chosen outlets on the manifold system.

Studded or threaded cross 24 is used to integrate the manifold into one unit from manually operated gate valves 22, and 26, for closing, blocking or diverting flow to alternate sides or ports on choke manifold 44. Air or hydraulic remotely operated valves 26, both preferably placed in a ninety degrees (90°) position from studded cross 24, are used to operate the system from a remote location by sending power from power supply 40 through valve operating cables 54, to activate remotely operated valves 26. A variable operated, adjustable choke valve 28 is installed on a port side of remotely operated valve 26, and one installed on the starboard side of remotely operated valve 26'. Variable adjustable chokes 28 are designed to control the rate of flow passing through lines, by blocking a seat opening with a cone shaped steel rod know as choke stem. In this flowback system, adjustable choke valves 28 are used only to pressure up the system when bringing a flowback online. An integrated one-piece adapter flange 30 preferred for its consistent smooth wear resistant bore qualities with a hammer union wing half connection, is mated to adjustable choke valves 28 manually operated gate valves 22, and attached to high-pressure flowlines 18.

A blast barrel 32 is installed and mated to one or more high-pressure flowlines 18, with matching connection types with a choke nipple, choke bean or choke insert with orifice size of choice into multiple chambers. As previously described, high-pressure flowlines 18 can be secured by additional adjustable cement blocks 56. The preferred blast barrel 32 is explained in more detail below and in FIG. 3. Blast barrel 32, once placed in line provides for an outer chamber of the blast barrel to slide away from the primary barrelhead to expose the inner flowtube, blast nipple and the cage nipple when rotated.

This apparatus also provides pressure ports that allow the monitoring of the upstream wellhead pressure by attaching electronic pressure sensor modules for monitoring by command center 34. The pressure sensor module signals are transmitted through sensor cables 48 to command center 34. Command center 34 can also provide an electronic or manual chart 38, that records and documents history of the process. This information can be used to document the efficiency and also help design procedure for future flowback.

Another important feature of blast barrel 32 is that it provides a center monitoring port located in the center of the outer barrel known as the breach chamber this chamber is equipped with internal high-pressure seals for containment. The monitoring port provides the system with a safe method to remotely monitor flowback operations away from the hazard or danger. The system is able to alert a technician by sending an alarm through monitoring cables 50 to command center 34 or via wireless communication systems to a remote command center 60. Command center 34 or remote command center 60 can automatically shut down the system or transmit a signal via valve operating cables 46 or 54, to close or open alternate lines. This function can be preferably conducted automatically or alternatively, manually.

Blast barrel assembly 32 is equipped with an expansion chamber in the lower assembly which provides the inner flowtube the ability to rotate counter clockwise, and travel away from the blast nipple and barrelhead, releasing it from the inner lock position, and unlocking the internal seals allowing the internal parts to be removed and replaced as required. The expansion chamber is also equipped with a third port for monitoring the low-pressure chamber. By monitoring this port via low-pressure monitoring cables 52 from a remote location, a technician is able to calculate wear by comparing the upstream high-pressure and down stream low-pressure differentials. For example, if there is 1000 PSI in the high-pressure barrelhead monitor, and a one-quarter inch (¼") orifice with one hundred twenty-five (125) PSI on the low-pressure monitor there is a pressure differential of eight hundred seventy-five (875) PSI. As the orifice begins to wear, the hole in the orifice becomes larger, and as this happens, the pressure on low-pressure chamber begins to increase, and the pressure on the high-pressure chamber remains the same. By using the charts and calculation, an operator is aware and able to avert washout or damage, and at the same time, maintain total control of the flowback process. These readings and information can be automatically recorded and documented on charts or graphs 38 in real time and transferred via a communication system 36 via a satellite or cell phone to any office or location of choice for real time evaluation. This information permits the site technician or central engineering office to view real time information from command center 34, and interpret it into useful data to be used in making crucial on-the-spot decisions, and execute operational functions safely away from hazards.

Also affixed to blast barrel assembly 32 are high-pressure flowlines 18 secured by adjustable cement blocks 56, and connected to one or more mufflers 58 for deflecting the water and sand into a pit during clean out.

Command center 34 incorporates many special features all working in cooperation to perform multiple functions upon request. A communication system 36, consisting of a transmitter and receiver are used to send and receive signals and data commands sent by command center 34. A data recording apparatus 38 is used to document data either electronically or mechanically. A series of electronic and mechanical valves in a manifold are able to execute receive commands sent by remote command center 60 or a mobile unit or vehicle via communications system 36 that transmits signals to activate electricity over hydraulic power packs 40 and electronic operated valve manifold 42, which activate and engage hydraulic or air power through cables 46 or 54. This opens or closes port 26 and 26' to maintain a constant back-pressure on the well.

Figure 2:
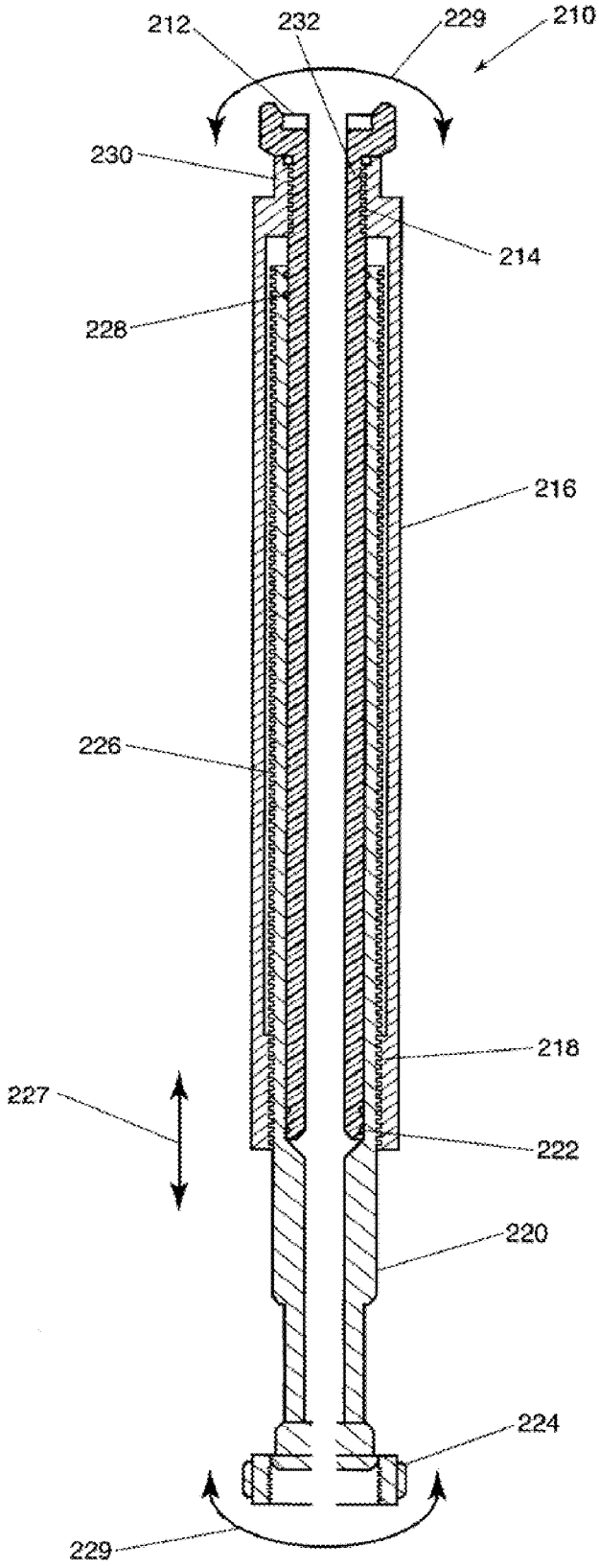
FIG. 2 is a cross sectional view of the expansion sub embodiment.

FIG. 2 shows a cross-sectional view of the preferred expansion sub 210. Expansion subs 210 are used for high-pressure lines. Expansion sub 210 has a primary inner master tube adapter chamber 232, this chamber 232 is equipped with external adapter threads 212 and these threads can be of various sizes and rating depending on application. In addition, the inner master tube adapter chamber 232 has a second set of threads 214 used to adapt and mate to master housing 216. Second set of threads or retainer threads 214, when rotated clockwise will engage and lock master housing 216 and inner master tube adapter chamber 232. Special external outer seals 222 and 230 located at both ends of master inner tube adapter capable of withstanding the rotation of expansion sub primary screw 220 and high internal flow pressures.

Master outer housing 216, houses and retains the assembly together when under pressure, and has a set of machined internal threads 218 located at end of master housing 216 for holding and retaining sub primary screw 220 in a fixed position. Machined internal threads 218 are designed for adequate strength to contain all forces equal to the rating of the assembly.

Expansion sub primary screw 220 has threads 226 and are designed and machined to a length equal to the length of master housing 216. Expansion sub primary screw 220 is configured to quickly expand or retract telescopically 227 to the desired length by rotation 229 of special double lead thread 226. Expansion sub primary screw 220 is also attached or installed by a hammer union 224, by rotating the wingnut potion of the union onto the threaded portion of the union. Expansion sub primary screw 220 is also able to contain the high internal pressure with special internal seals 228 located at the end of expansion sub primary screw 220.

Expansion sub assembly 210, is a mechanism with axial adjusting lengths, for telescopic expansion or retraction 227, adequate to compensate for variations in a distance between two fixed points, allowing expansion sub 210 to be secured and installed precisely and quickly into a vertical position, eliminating the need of having to cut, fit, thread, weld, or field fabricate.

Figure 3:
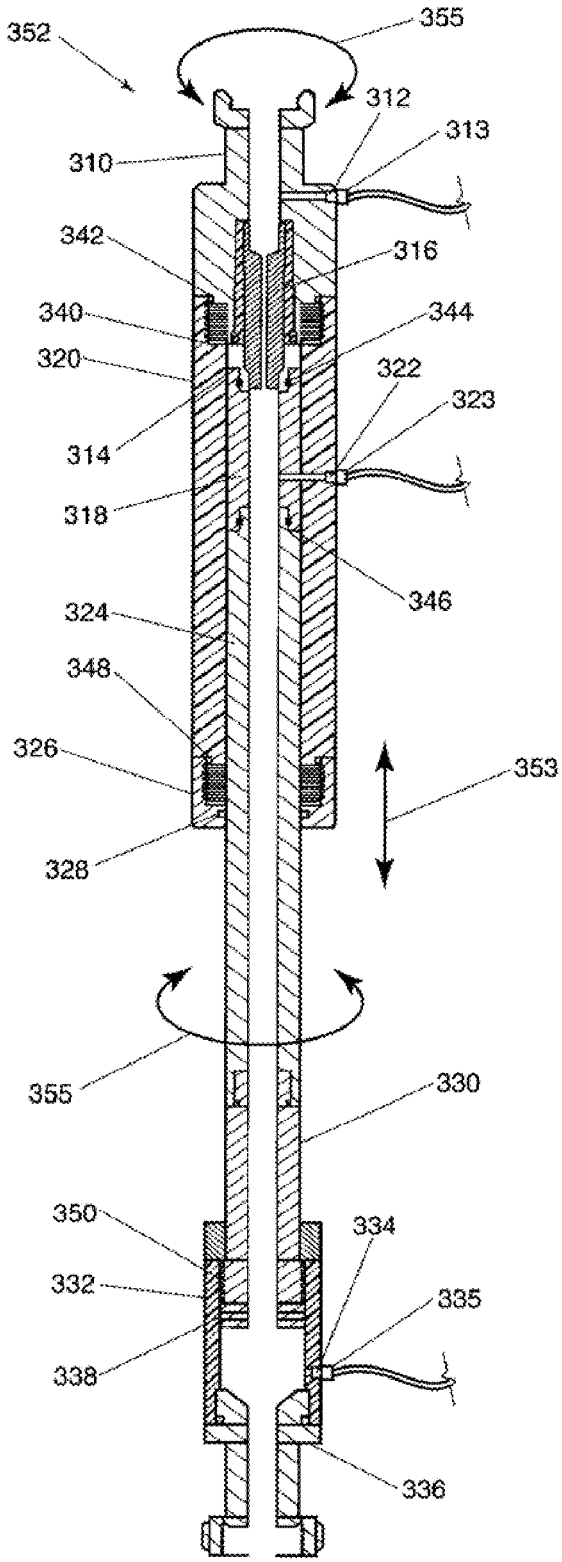
FIG. 3 is a cross sectional view of the preferred blast barrel.

FIG. 3 is a cross sectional view of the preferred blastbarrel 352. This apparatus provides several unique functions. First, it attaches between two high-pressure lines, second, it provides a high-pressure port 312 where a pressure sending module or line 313 can be installed, and third, this apparatus has an internal preparation system that accepts a cage nipple 314 used to hold a choke insert 316. Before outer barrel 320 is assembled to barrelhead 310, choke insert 316 must be installed into cage nipple 314 by rotating cage nipple 314 clockwise until tight. Cage nipple assembly 314 can now be installed into barrelhead 310 by rotating cage nipple 314 clockwise until seal 340 engages and is tight. These unique functions give blastbarrel assembly 352 the ability to telescopically retract 353 between two fixed points by rotating outer barrel 320 from second inner flowtube 330 without having to disassemble or dismantle any connections or be removed from the secured flowlines to install or replace damaged or used internal parts.

Blast nipple 318 is installed by sliding over cage nipple 314 and locking into place. By rotating clockwise, inner flowtubes 324 and 330 will engage into blast nipple 318 and seals 344 and 346. Outer barrel 320 is moved forward towards barrelhead 310 until threads from outer barrel 320 contact treads from barrelhead 310. Once contact is made, outer barrel 320 can be rotated clockwise until barrelhead 310 and outer barrel 320 make contact and are tight.

Outer barrel or breach chamber 320 is the master safety housing. It contains a pressure port 322 where a pressure sensor or line 323 can be installed. Outer barrel 320 or the breach chamber, contains the pressure and abrasives, should a breach occur. Pressure port 322 is the second port in the center of outer barrel 320; it is designed to notify the user, via sensors 323 that a breach has taken place. The assembly contains a lockdown retainer cap 326 to secure the first inner flowtube 324 by abutting against a no go shoulder once it is assembled on outer barrel 320 and lockdown retainer cap 326. Master chamber seals 348 in outer barrel 320, barrel head seals 342 and retainer cap 328 prevent flow from outer barrel 320 or first inner flowtube 234. Second inner flowtube 330 is installed before installing expansion chamber tunnel head 336 through the rear of expansion chamber housing 332 and seal chamber. Once the treads on second inner flowtube 330 contact the inner drive head 350 thread, second inner flowtube 330 is rotated clockwise until drive head 338 meets and butts up against the body of chamber housing 332. Expansion chamber funnel head 336 can now be installed by rotating clockwise until tunnel head 336 butts up against expansion chamber housing 332. First inner flowtube 324 is connected to second inner flowtube 330 and the expansion chamber inner drive head 338. Expansion chamber housing 332 is designed with a low-pressure port 334 to monitor the down stream low-pressure, via low pressure sensor 335. Expansion chamber housing assembly 332, and connection to second inner flowtube 330 can be installed by rotating clockwise until tight to first inner flowtube 324. The blast barrel assembly is now ready for installation.

The blast barrel is unique because even if the inner parts have been compromised and need to be changed, it remains safe due to the inner choke insert and the inner blast nipple, both made from hardened tool material, giving it the ability to withstand the corrosive demand made upon equipment during the flowback process for long periods of time; unlike standard pipe or steel. If a breach occurs, the system is still safe and secure because the inner tubes and parts are encased with the outer barrel or breach chamber that is able to contain the pressures and abrasives internally for an indefinite amount of time allowing the operator/technician adequate time to shut down and transfer to another flowline equipped with the same equipment.

Although the invention has been described in detail with particular reference to these preferred embodiments, other embodiments can achieve the same results. Variations and modifications of the present invention will be obvious to those skilled in the art and it is intended to cover in the appended claims all such modifications and equivalents. The entire disclosures of all references, applications, patents, and publications cited above, are hereby incorporated by reference.

What is claimed is:

1. An automatic flowback system for providing a controlled flowback from a wellbore after a treatment procedure, the system comprising:

at least one telescopic expansion coupling with adjusting lengths adequate to compensate for variations between two points for adjusting and installing between the two points for high pressure fluid flow from the wellbore;

at least one blast barrel for containing and controlling the high pressure fluid flow from the wellbore, the at least one blast barrel comprising at least one nipple, at least one insert with a chosen orifice size for multiple chambered ports disposed on an inner flow tube and further comprising an outer chamber for containing a fluid breach from said inner flow tube, said outer chamber being configured to expose the at least one nipple and at least one insert and said inner flow tube for maintenance by rotating said outer chamber without dismantling the at least one blast barrel from connected high pressure lines; and a monitoring and communication apparatus for monitoring pressures by sensors disposed on the flowback system, for transmitting the monitored pressures and for remotely operating valves in the flowback system.

2. The automatic flowback system of claim 1 wherein the blast barrel comprises a telescopic blast barrel.

3. The automatic flowback system of claim 2 wherein the telescopic blast barrel comprises an adjustable length blast barrel.

4. The automatic flowback system of claim 1 wherein the at least one nipple comprises a cage nipple and a blast nipple.

5. The automatic flow back system of claim 1 wherein the at least one insert comprises a choke insert.

6. A method controlling flowback from a wellbore after a treatment procedure, the method comprising the steps of:

adjusting a length of at least one telescopic expansion coupling and installing the telescopic expansion coupling between the two points of a high pressure fluid flow of the wellbore;

installing at least one blast barrel for controlling and containing the high pressure fluid flow of the at least one blast barrel comprising at least one nipple, at least one insert with a chosen orifice size for multiple chambered ports disposed on an inner flow tube, and further comprising an outer chamber for containing a fluid breach, said outer chamber being configured to expose the at least one nipple and at least one insert and said flow tube for maintenance by rotating said outer chamber without dismantling the at least one blast barrel from connected high pressure lines;

flowing the high pressure fluid from the wellbore; and monitoring pressures in the flowback system and transmitting the monitored pressures to a remote location.

7. The method of claim 6 further comprising the step of remotely operating valves in the flowback system.

8. The method of claim 6 wherein the step of monitoring comprises monitoring sensors disposed in the at least one blast barrel.

9. The method of claim 6 further comprising the step of telescopically adjusting a length of the blast barrel.

10. The method of claim 6 wherein the at least one nipple comprises a cage nipple and a blast nipple.

11. The method of claim 6 wherein the at least one insert comprises a choke insert.

12. A blast barrel located above ground for containing and controlling a high pressure fluid flow from the wellbore in a flowback system, the blast barrel comprising:

an outer chamber; and a primary barrelhead adjustably affixed inside the outer chamber, wherein the primary barrelhead comprises at least one nipple, at least one choke, wherein the at least one nipple and at least one choke are exposed for maintenance by rotating the chamber from the primary barrelhead without dismantling the at least one blast barrel from connected high pressure lines.

13. The blast barrel of claim 12 wherein the at least one nipple comprises a cage nipple with a choke insert.

14. The blast barrel of claim 12 further comprising a high pressure port disposed on the outer chamber.

15. The blast barrel of claim 12 further comprising at least one sensor affixed to a high pressure port for sensing a fluid pressure.

16. The blast barrel of claim 12 further comprising a low pressure port for sensing a fluid pressure downstream from the primary barrelhead.

17. The blast barrel of claim 12 further comprising an adjustable length telescopic blast barrel.

18. The blast barrel of claim 12 wherein the at least one nipple and at least one choke are disposed in a barrel.

19. A method of containing and controlling a high pressure fluid flow from the wellbore in a flowback system using a blast barrel located above ground, the method comprising the steps of:

directing a flow of the high pressure fluid to an input of an outer chamber; and choking the flow with a choke in a primary barrelhead adjustably affixed inside the outer chamber, wherein the choke is exposed for maintenance by rotating the outer chamber without dismantling the at least one blast barrel from connected high pressure lines.

20. The method of claim 19 further comprising the step of directing the flow of choked fluid to a blast nipple.

21. The method of claim 19 further comprising the step of sensing a pressure of the directed flow of high pressure fluid.

22. The method of claim 19 further comprising the step of sensing a breach of the fluid in the primary barrelhead.

* * * * *